US006533682B2

(12) United States Patent
Sullivan

(10) Patent No.: US 6,533,682 B2
(45) **Date of Patent: *Mar. 18, 2003**

(54) GOLF BALL

(75) Inventor: Michael J. Sullivan, Barrington, RI (US)

(73) Assignee: Acushnet Company, Fairhaven, MA (US)

( * ) Notice: Subject to any disclaimer, the term of this patent is extended or adjusted under 35 U.S.C. 154(b) by 64 days.

This patent is subject to a terminal disclaimer.

(21) Appl. No.: 09/842,574

(22) Filed: Apr. 26, 2001

(65) Prior Publication Data

US 2002/0173383 A1 Nov. 21, 2002

Related U.S. Application Data

(63) Continuation-in-part of application No. 09/815,753, filed on Mar. 23, 2001.

(51) Int. Cl.[7] ..... A63B 37/04; A63B 37/06; A63B 37/00

(52) U.S. Cl. ..... 473/371; 473/376; 473/377; 473/351; 473/361

(58) Field of Search ..... 473/351–377

(56) References Cited

U.S. PATENT DOCUMENTS

| | | | | |
|---|---|---|---|---|
| 4,625,964 A | | 12/1986 | Yamada | |
| 5,048,838 A | | 9/1991 | Chikaraishi et al. | |
| 5,104,126 A | | 4/1992 | Gentiluomo | |
| 5,482,285 A | | 1/1996 | Yabuki et al. | |
| 5,508,351 A | * | 4/1996 | Horiuchi et al. | 473/385 |
| 5,816,938 A | * | 10/1998 | Kakiuchi | 473/354 |
| 5,823,889 A | | 10/1998 | Aoyama | 473/374 |
| 5,824,746 A | | 10/1998 | Harris et al. | 525/196 |
| 5,885,172 A | | 3/1999 | Hebert et al. | 473/354 |
| 5,919,100 A | | 7/1999 | Boehm et al. | 473/354 |
| 5,947,843 A | | 9/1999 | Calabria et al. | 473/377 |
| 5,989,136 A | | 11/1999 | Renard et al. | 473/376 |
| 5,993,968 A | | 11/1999 | Umezawa et al. | 428/407 |
| 6,010,411 A | | 1/2000 | Reyes | 473/345 |
| 6,025,442 A | | 2/2000 | Harris et al. | 525/221 |
| 6,030,296 A | | 2/2000 | Morgan et al. | 473/361 |
| 6,120,393 A | | 9/2000 | Sullivan et al. | 473/377 |
| 6,142,887 A | | 11/2000 | Sullivan et al. | 473/374 |
| 6,149,535 A | | 11/2000 | Bissonnette et al. | 473/354 |
| 6,152,834 A | | 11/2000 | Sullivan | 473/365 |
| 6,196,937 B1 | * | 3/2001 | Kuttappa | 264/250 |
| 6,238,304 B1 | * | 5/2001 | Scolamiero et al. | 473/354 |
| 6,315,680 B1 | * | 11/2001 | Dalton et al. | 473/373 |
| 6,431,998 B1 | * | 8/2002 | Nakamura et al. | 473/371 |
| 6,431,999 B1 | * | 8/2002 | Nesbitt | 473/371 |
| 6,450,898 B1 | * | 9/2002 | Nesbitt et al. | 473/372 |
| 2001/0019969 A1 | | 9/2001 | Binette et al. | 473/354 |
| 2002/0013185 A1 | | 1/2002 | Sullivan et al. | 473/373 |

FOREIGN PATENT DOCUMENTS

| | | |
|---|---|---|
| WO | 00/23519 | 4/2000 |
| WO | 00/57962 | 10/2000 |

* cited by examiner

*Primary Examiner*—Raleigh W. Chiu
*Assistant Examiner*—Alvin A. Hunter, Jr.
(74) *Attorney, Agent, or Firm*—William B. Lacy; Troy R. Lester

(57) ABSTRACT

A golf ball with a precise spin rate is disclosed. The distribution of weight among the layers within the golf ball relative to a centroid radius is realized to precisely control the moment of inertia of the ball. In accordance to one aspect of the present invention, the innermost core of the ball is made from a specific gravity reduced material, and a thin dense layer is accurately located either inside or outside of the centroid radius to create a high spin ball or a low spin ball, respectively, with a high compression and soft feel.

14 Claims, 2 Drawing Sheets

GOLF BALL

CROSS-REFERENCE TO RELATED APPLICATIONS

This application is a continuation-in-part of co-pending patent application entitled "Golf Ball and a Method for Controlling the Spin Rate of Same," bearing application Ser. No. 09/815,753, filed on Mar. 23, 2001, which is herein incorporated by reference in its entirety.

FIELD OF THE INVENTION

The present invention relates to golf balls and more particularly, the invention is directed to improving the control of the spin rate of golf balls and to a method for varying the spin rate of golf balls.

BACKGROUND OF THE INVENTION

The spin rate of golf balls is the end result of many variables, one of which is the distribution of the density or specific gravity within the ball. Spin rate is an important characteristic of golf balls for both skilled and recreational golfers. High spin rate allows the more skilled players, such as PGA professionals and low handicapped players, to maximize control of the golf ball. A high spin rate golf ball is advantageous for an approach shot to the green. The ability to produce and control back spin to stop the ball on the green and side spin to draw or fade the ball substantially improves a player's control over the ball. Hence, the more skilled players generally prefer a golf ball that exhibits high spin rate, in part, off scoring irons (7-PW).

On the other hand, the recreational players who cannot intentionally control the spin of the ball generally do not prefer a high spin rate golf ball. For these players, slicing and hooking the ball are the more immediate obstacles. When a club head strikes a ball improperly, an unintentional side spin is often imparted to the ball, which sends the ball off its intended course. The side spin reduces a player's control over the ball, as well as the direct-line distance the ball will travel. A golf ball that spins less tends not to drift off-line erratically if the shot is not hit squarely with the club face. A low spin ball will not cure the hook or slice, but will reduce the adverse effects of the side spin. Hence, recreational players typically prefer a golf ball that exhibits low spin rate.

Reallocating the density or specific gravity of the various layers of a golf ball provides an important means of controlling the spin rate. In some instances, the weight from the outer portions of the ball is redistributed toward the center to decrease the moment of inertia, thereby increasing the spin rate. For example, U.S. Pat. No. 4,625,964 discloses a golf ball with a reduced moment of inertia having a core with specific gravity of at least 1.50 and a diameter of less than 32 mm and an intermediate layer of lower specific gravity between the core and the cover. U.S. Pat. No. 5,104,126 discloses a ball with a dense inner core having a specific gravity of at least 1.25 encapsulated by a lower density syntactic foam composition. U.S. Pat. No. 5,048,838 discloses another golf ball with a dense inner core having a diameter in the range of 15–25 mm with a specific gravity of 1.2 to 4.0 and an outer layer with a specific gravity of 0.1 to 3.0 less than the specific gravity of the inner core. U.S. Pat. No. 5,482,285 discloses another golf ball with reduced moment of inertia by reducing the specific gravity of an outer core to 0.2 to 1.0.

In other instances, the weight from the inner portion of the ball is redistributed outward to increase the moment of inertia, thereby decreasing the spin rate. U.S. Pat. No. 6,120,393 discloses a golf ball with a hollow inner layer with one or more resilient outer layers, thereby giving the ball a soft core, and a hard cover. U.S. Pat. No. 6,142,887 discloses an increased moment of inertia golf ball comprising one or more layer layers made from metals, ceramic or composite materials, and a polymeric spherical substrate disposed inwardly from the layer layers.

These and other references disclose specific examples of high and low spin rate ball with ranges of specific gravity, ranges of diameter for the core, and ranges of thickness for the outer layers, for example. They, however, do not offer any universal guidelines to control the spin rate of golf balls. Hence, there remains a need in the art for an improved golf ball with controlled spin rates.

SUMMARY OF THE INVENTION

The present invention is directed to a golf ball with a controlled moment of inertia. The present invention is also directed to a golf ball with a controlled spin rate. The present invention is further directed to a golf ball with a controlled spin rate, soft compression and high resiliency.

These and other embodiments of the invention are realized by a golf ball with its weight distributed among the layers within the core of the golf ball relative to a centroid radius to precisely control the moment of inertia of the ball. In accordance to one aspect of the present invention, the innermost core of the ball comprises a specific gravity reduced material, surrounded by a thin dense layer located either to the inside or to the outside of a centroid radius to create a high spin ball or a low spin ball, respectively, with high compression and a soft feel. The ball may also have additional specific gravity reduced layers or a wound layer to improve the play characteristics of the ball. According to another aspect of the invention, the inner core, the intermediate layer and the outer core may comprise a specific gravity gradient increasing toward the outside of the ball, or a specific gravity gradient increasing toward the center of the ball.

BRIEF DESCRIPTION OF THE DRAWINGS

In the accompanying drawings which form a part of the specification and are to be read in conjunction therewith and in which like reference numerals are used to indicate like parts in the various views.

DETAILED DESCRIPTION OF THE INVENTION

Figure 1:
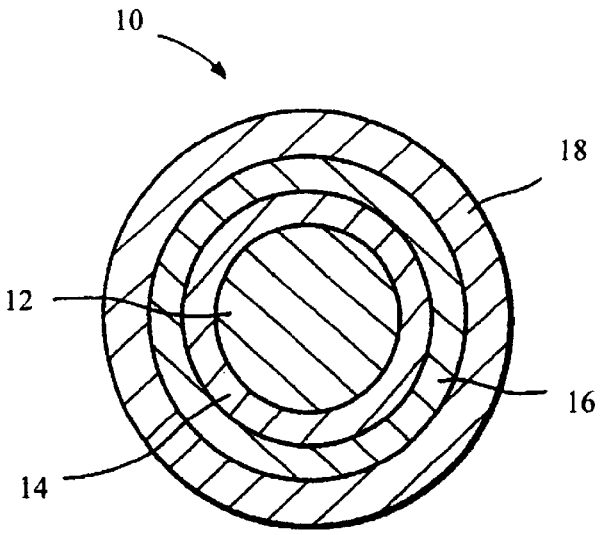
FIG. 1 is a cross-sectional view of a golf ball 10 having an inner core 12, at least two intermediate layers 14, 16 and an outer cover 18 in accordance to an embodiment of the present invention.
Figure 2:
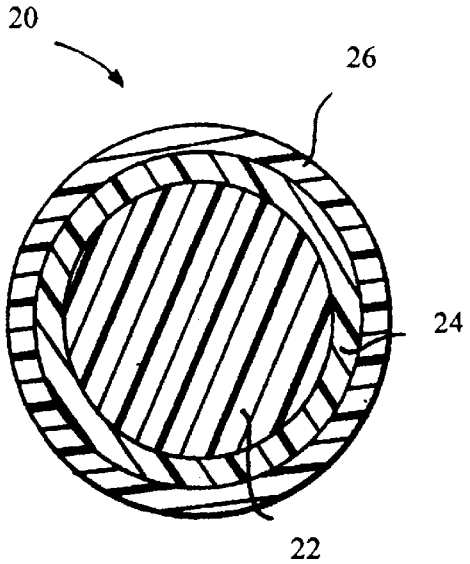
FIG. 2 is a cross-sectional view of a golf ball 20 having inner core 22, at least one intermediate layer 24 and an outer cover 26 in accordance to another embodiment of the present invention.
Figure 3:
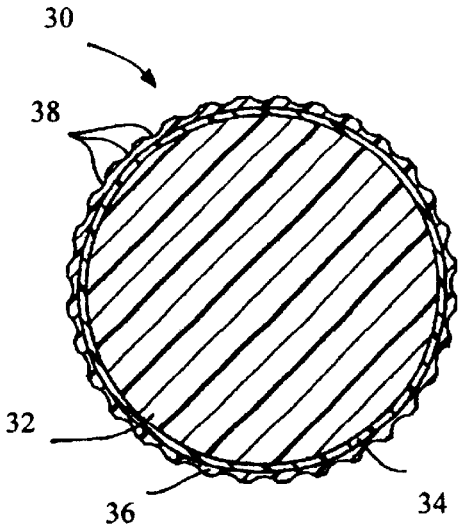
FIG. 3 is a cross-sectional view of a golf ball 30 having inner core 32, a thin layer 34 and an outer cover 36.

Referring generally to FIGS. 1, 2 and 3 where golf balls 10, 20 and 30 are shown, it is well known that the total weight of the ball has to conform to the weight limit set by the United States Golf Association ("USGA"). Redistributing the weight or mass of the ball either toward the center of the ball or toward the outer surface of the ball changes the dynamic characteristics of the ball at impact and in flight. Specifically, if the density is shifted or redistributed toward the center of the ball, the moment of inertia is reduced, and the initial spin rate of the ball as it leaves the golf club would increase due to lower resistance from the ball's moment of inertia. Conversely, if the density is shifted or redistributed toward the outer cover, the moment of inertia is increased, and the initial spin rate of the ball as it leaves the golf club would decrease due to the higher resistance from the ball's moment of inertia. The radial distance from the center of the ball or from the outer cover, where moment of inertia switches from being increased and to being decreased as a result of the redistribution of weight or mass density, is an important factor in golf ball design.

In accordance to one aspect of the present invention, this radial distance, hereinafter referred to as the centroid radius, is provided. When more of the ball's mass or weight is reallocated to the volume of the ball from the center to the centroid radius, the moment of inertia is decreased, thereby producing a high spin ball. When more of the ball's mass or weight is reallocated to the volume between the centroid radius and the outer cover, the moment of inertia is increased thereby producing a low spin ball.

The centroid radius can be determined by the following steps:

(a) Setting Ro to half of the 1.68-inch diameter for an average size ball, where Ro is the outer radius of the ball.

(b) Setting the weight of the ball to the USGA legal weight of 1.62 oz.

(c) Determining the moment of inertia of a ball with evenly distributed density prior to any weight distribution.

The moment of inertia is represented by (2/5)(Mt)($Ro^2$), where Mt is the total mass or weight of the ball. For the purpose of this invention, mass and weight can be used interchangeably. The formula for the moment of inertia for a sphere through any diameter is given in the CRC Standard Mathematical Tables, $24^{th}$ Edition, 1976 at 20 (hereinafter CRC reference). The moment of inertia of such a ball is 0.4572 oz-$inch^2$. This will be the baseline moment of inertia value.

(d) Taking a predetermined amount of weight uniformly from the ball and reallocating this predetermined weight in the form of a thin shell to a location near the center of the ball and calculating the new moment of inertia of the weight redistributed ball.

This moment of inertia is the sum of the inertia of the ball with the reduced weight plus the moment of inertia contributed by the thin shell.

This new moment of inertia is expressed as (2/5)(Mr)($Ro^2$)+(2/3)(Ms)($Rs^2$), where Mr is the reduced weight of the ball; Ms is the weight of the thin shell; and Rs is the radius of the thin shell measured from the center of the ball. Also, Mt=Mr+Ms. The formula of the moment of inertia from a thin shell is also given in the CRC reference.

(e) Comparing the new moment of inertia determined in step (d) to the baseline inertia value determined in step (c) to determine whether the moment of inertia has increased or decreased due to the reallocation of weight, i.e., subtracting the baseline inertia from the new inertia.

(f) Repeating steps (d) and (e) with the same predetermined weight incrementally moving away from the center of the ball until the predetermined weight reaches the outer surface of the ball.

(g) Determining the centroid radius as the radial location where the moment of inertia changes from increasing to decreasing.

(h) Repeating steps (d), (e), (f), and (g) with different predetermined weights and confirming that the centroid radius is the same for each predetermined weight.

In a preferred embodiment of the present invention, the predetermined weight is initially set at a very small weight, e.g., 0.01 oz, and the location of the thin shell is initially placed at 0.01 inches radially from the center of the ball. The 0.01 oz thin shell is then moved radially and incrementally away from the center. The results are reported in the following table:

TABLE 1

| 0.01 Ounce Weight | | | | |
|---|---|---|---|---|
| Radius (inch) | Inertia (reduced) | Inertia (0.01 shell) | Inertia (new) | Changes in Inertia |
| 0.010 | 0.4544 | 0.000001 | 0.4544 | −0.0028 |
| 0.020 | 0.4544 | 0.000003 | 0.4544 | −0.0028 |
| 0.025 | 0.4544 | 0.000004 | 0.4544 | −0.0028 |
| 0.050 | 0.4544 | 0.000017 | 0.4544 | −0.0028 |
| 0.100 | 0.4544 | 0.000067 | 0.4545 | −0.0027 |
| 0.150 | 0.4544 | 0.000150 | 0.4546 | −0.0026 |
| 0.200 | 0.4544 | 0.000267 | 0.4547 | −0.0025 |
| 0.250 | 0.4544 | 0.000417 | 0.4548 | −0.0024 |
| 0.300 | 0.4544 | 0.000600 | 0.4550 | −0.0022 |
| 0.350 | 0.4544 | 0.000817 | 0.4552 | −0.0020 |
| 0.400 | 0.4544 | 0.001067 | 0.4555 | −0.0017 |
| 0.450 | 0.4544 | 0.001350 | 0.4558 | −0.0014 |
| 0.500 | 0.4544 | 0.001667 | 0.4561 | −0.0011 |
| 0.550 | 0.4544 | 0.002017 | 0.4564 | −0.0008 |
| 0.600 | 0.4544 | 0.002400 | 0.4568 | −0.0004 |
| 0.650 | 0.4544 | 0.002817 | 0.4572 | 0.0000 |
| 0.700 | 0.4544 | 0.003267 | 0.4577 | 0.0005 |
| 0.750 | 0.4544 | 0.003750 | 0.4582 | 0.0010 |
| 0.800 | 0.4544 | 0.004267 | 0.4587 | 0.0015 |
| 0.840 | 0.4544 | 0.004704 | 0.4591 | 0.0019 |

The results shows that for a 1.62 oz ball with a 1.68-inch diameter, the centroid radius is approximately at 0.65 inches radially away from the center of the ball or approximately 0.19 inches radially inward from the outer surface. In other words, when the reallocated weight is positioned at a radial distance about 0.65 inches, the new moment of inertia of the ball is the same as the baseline moment of inertia of a uniform density ball. To ensure that the preferred method of determining the centroid radius discussed above is a correct one, the same calculation was repeated for predetermined weights of 0.20 oz, 0.405 oz (¼ of the total weight of the ball), 0.81 oz (½ of the total weight) and 1.61 oz (practically all of the weight). The results are reported in the following tables:

TABLE 2

| 0.20 Ounce Weight | | | | |
|---|---|---|---|---|
| Radius (inch) | Inertia (reduced) | Inertia (0.20 shell) | Inertia (new) | Changes in Inertia |
| 0.010 | 0.4008 | 0.000013 | 0.4008 | −0.0564 |
| 0.020 | 0.4008 | 0.000053 | 0.4008 | −0.0564 |
| 0.025 | 0.4008 | 0.000083 | 0.4009 | −0.0563 |
| 0.050 | 0.4008 | 0.000333 | 0.4011 | −0.0561 |

TABLE 2-continued

| 0.20 Ounce Weight | | | | |
|---|---|---|---|---|
| Radius (inch) | Inertia (reduced) | Inertia (0.20 shell) | Inertia (new) | Changes in Inertia |
| 0.100 | 0.4008 | 0.001333 | 0.4021 | −0.0551 |
| 0.150 | 0.4008 | 0.003000 | 0.4038 | −0.0534 |
| 0.200 | 0.4008 | 0.005333 | 0.4061 | −0.0511 |
| 0.250 | 0.4008 | 0.008333 | 0.4091 | −0.0481 |
| 0.300 | 0.4008 | 0.012000 | 0.4128 | −0.0444 |
| 0.350 | 0.4008 | 0.016333 | 0.4171 | −0.0401 |
| 0.400 | 0.4008 | 0.021333 | 0.4221 | −0.0351 |
| 0.450 | 0.4008 | 0.027000 | 0.4278 | −0.0294 |
| 0.500 | 0.4008 | 0.033333 | 0.4341 | −0.0231 |
| 0.550 | 0.4008 | 0.040333 | 0.4411 | −0.0161 |
| 0.600 | 0.4008 | 0.048000 | 0.4488 | −0.0084 |
| 0.650 | 0.4008 | 0.056333 | 0.4571 | 0.0001 |
| 0.700 | 0.4008 | 0.065333 | 0.4661 | 0.0089 |
| 0.750 | 0.4008 | 0.075000 | 0.4758 | 0.0186 |
| 0.800 | 0.4008 | 0.085333 | 0.4861 | 0.0289 |
| 0.840 | 0.4008 | 0.094080 | 0.4949 | 0.0377 |

TABLE 3

| 0.405 Ounce Weight | | | | |
|---|---|---|---|---|
| Radius (inch) | Inertia (reduced) | Inertia (0.405 shell) | Inertia (new) | Changes in Inertia |
| 0.010 | 0.3429 | 0.000027 | 0.3429 | −0.1143 |
| 0.020 | 0.3429 | 0.000108 | 0.3430 | −0.1142 |
| 0.025 | 0.3429 | 0.000169 | 0.3431 | −0.1141 |
| 0.050 | 0.3429 | 0.000675 | 0.3436 | −0.1136 |
| 0.100 | 0.3429 | 0.002700 | 0.3456 | −0.1116 |
| 0.150 | 0.3429 | 0.006075 | 0.3490 | −0.1082 |
| 0.200 | 0.3429 | 0.010800 | 0.3537 | −0.1035 |
| 0.250 | 0.3429 | 0.016875 | 0.3598 | −0.0974 |
| 0.300 | 0.3429 | 0.024300 | 0.3672 | −0.0900 |
| 0.350 | 0.3429 | 0.033075 | 0.3760 | −0.0812 |
| 0.400 | 0.3429 | 0.043200 | 0.3861 | −0.0711 |
| 0.450 | 0.3429 | 0.054675 | 0.3976 | −0.0596 |
| 0.500 | 0.3429 | 0.067500 | 0.4104 | −0.0468 |
| 0.550 | 0.3429 | 0.081675 | 0.4246 | −0.0326 |
| 0.600 | 0.3429 | 0.097200 | 0.4401 | −0.0171 |
| 0.650 | 0.3429 | 0.114075 | 0.4570 | −0.0002 |
| 0.700 | 0.3429 | 0.132300 | 0.4752 | 0.0180 |
| 0.750 | 0.3429 | 0.151875 | 0.4948 | 0.0376 |
| 0.800 | 0.3429 | 0.172800 | 0.5157 | 0.0585 |
| 0.840 | 0.3429 | 0.190512 | 0.5334 | 0.0762 |

TABLE 4

| 0.81 Ounce Weight | | | | |
|---|---|---|---|---|
| Radius (inch) | Inertia (reduced) | Inertia (0.81 shell) | Inertia (new) | Changes in Inertia |
| 0.010 | 0.2286 | 0.000054 | 0.2287 | −0.2285 |
| 0.020 | 0.2286 | 0.000216 | 0.2288 | −0.2284 |
| 0.025 | 0.2286 | 0.000338 | 0.2290 | −0.2282 |
| 0.050 | 0.2286 | 0.001350 | 0.2300 | −0.2272 |
| 0.100 | 0.2286 | 0.005400 | 0.2340 | −0.2232 |
| 0.150 | 0.2286 | 0.012150 | 0.2408 | −0.2164 |
| 0.200 | 0.2286 | 0.021600 | 0.2502 | −0.2070 |
| 0.250 | 0.2286 | 0.033750 | 0.2624 | −0.1948 |
| 0.300 | 0.2286 | 0.048600 | 0.2772 | −0.1800 |
| 0.350 | 0.2286 | 0.066150 | 0.2948 | −0.1624 |
| 0.400 | 0.2286 | 0.086400 | 0.3150 | −0.1422 |
| 0.450 | 0.2286 | 0.109350 | 0.3380 | −0.1192 |
| 0.500 | 0.2286 | 0.135000 | 0.3636 | −0.0936 |
| 0.550 | 0.2286 | 0.163350 | 0.3920 | −0.0652 |
| 0.600 | 0.2286 | 0.194400 | 0.4230 | −0.0342 |
| 0.650 | 0.2286 | 0.228150 | 0.4568 | −0.0004 |

TABLE 4-continued

| 0.81 Ounce Weight | | | | |
|---|---|---|---|---|
| Radius (inch) | Inertia (reduced) | Inertia (0.81 shell) | Inertia (new) | Changes in Inertia |
| 0.700 | 0.2286 | 0.264600 | 0.4932 | 0.0360 |
| 0.750 | 0.2286 | 0.303750 | 0.5324 | 0.0752 |
| 0.800 | 0.2286 | 0.345600 | 0.5742 | 0.1170 |
| 0.840 | 0.2286 | 0.381024 | 0.6096 | 0.1524 |

TABLE 5

| 1.61 Ounce Weight | | | | |
|---|---|---|---|---|
| Radius (inch) | Inertia (reduced) | Inertia (1.61 shell) | Inertia (new) | Changes in Inertia |
| 0.010 | 0.0028 | 0.000107 | 0.0029 | −0.4543 |
| 0.020 | 0.0028 | 0.000429 | 0.0033 | −0.4539 |
| 0.025 | 0.0028 | 0.000671 | 0.0035 | −0.4537 |
| 0.050 | 0.0028 | 0.002683 | 0.0055 | −0.4517 |
| 0.100 | 0.0028 | 0.010733 | 0.0136 | −0.4436 |
| 0.150 | 0.0028 | 0.024150 | 0.0270 | −0.4302 |
| 0.200 | 0.0028 | 0.042933 | 0.0458 | −0.4114 |
| 0.250 | 0.0028 | 0.067083 | 0.0699 | −0.3873 |
| 0.300 | 0.0028 | 0.096600 | 0.0994 | −0.3578 |
| 0.350 | 0.0028 | 0.131483 | 0.1343 | −0.3229 |
| 0.400 | 0.0028 | 0.171733 | 0.1746 | −0.2826 |
| 0.450 | 0.0028 | 0.217350 | 0.2202 | −0.2370 |
| 0.500 | 0.0028 | 0.268333 | 0.2712 | −0.1860 |
| 0.550 | 0.0028 | 0.324683 | 0.3275 | −0.1297 |
| 0.600 | 0.0028 | 0.386400 | 0.3892 | −0.0680 |
| 0.650 | 0.0028 | 0.453483 | 0.4563 | −0.0009 |
| 0.700 | 0.0028 | 0.525933 | 0.5288 | 0.0716 |
| 0.750 | 0.0028 | 0.603750 | 0.6066 | 0.1494 |
| 0.800 | 0.0028 | 0.686933 | 0.6898 | 0.2326 |
| 0.840 | 0.0028 | 0.757344 | 0.7602 | 0.3030 |

In each case, the centroid radius is located at the same radial distance, i.e., at approximately 0.65 inches radially from the center of a ball weighing 1.62 oz and with a diameter of 1.68 inches. A graph of the "Changes in Inertia" value versus radial distance for each predetermined weight, shown in FIG. 4, where the x-axis is the radial distance and the y-axis is the "Changes in Inertia," confirms that the centroid radius is located approximately 0.65 inches radially away from the center of the ball.

Figure 4:
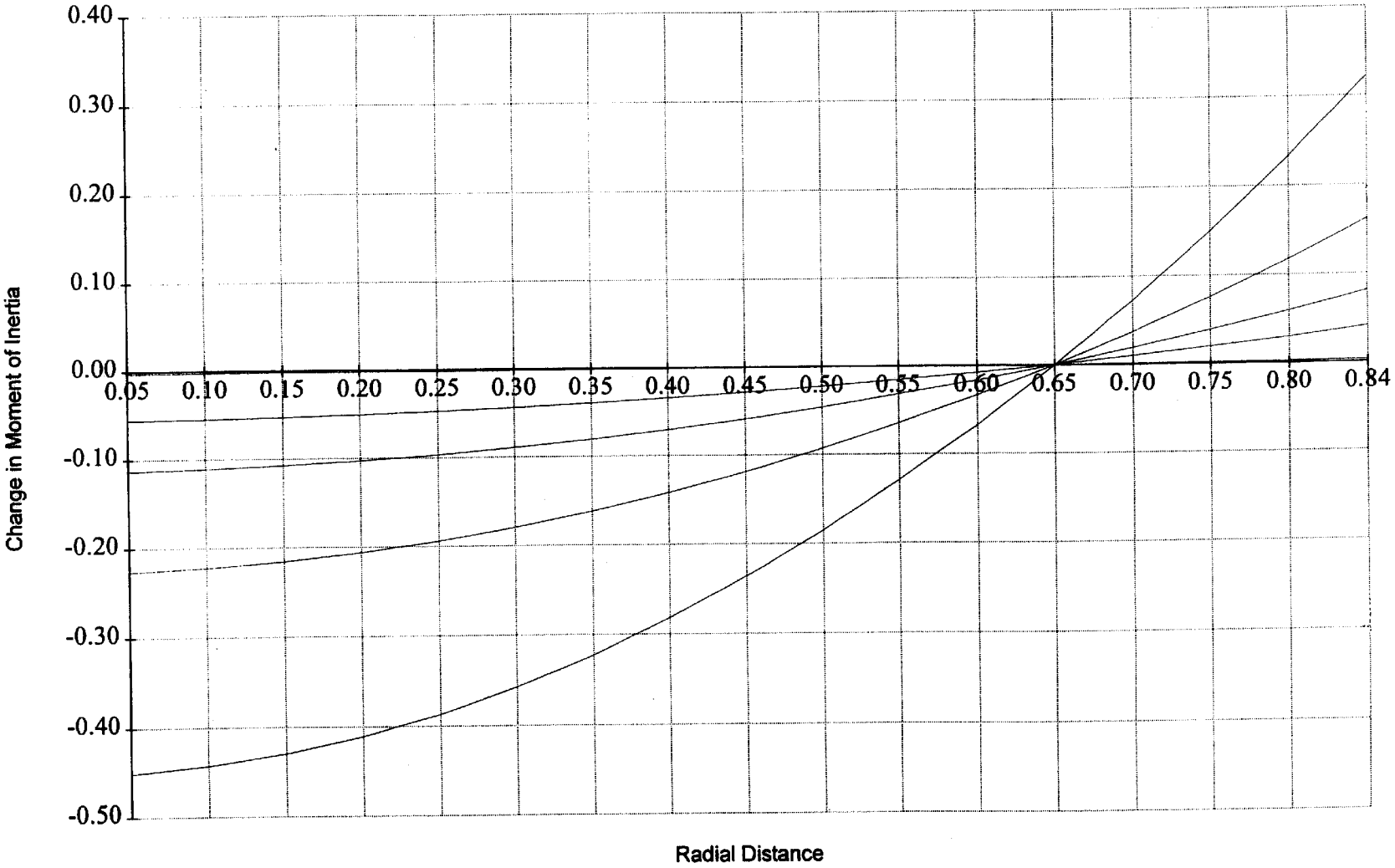
FIG. 4 is a graph showing the determination of the centroid radius in accordance to an aspect of the present invention.

Another advantageous result readily derived from FIG. 4 is that at a radial distance of less than 0.20 inches (about 5.1 mm) from center the reduction in moment of inertia is considerably less than the reduction in moment of inertia from a radial distance from 0.20 inches to 0.65 inches (5.1 mm to 16.5 mm).

Furthermore, when the weight redistribution is not a thin shell but is a more uniformly allocation of weight, the centroid radius also accurately predicts the changes in the moments of inertia. The table below shows the changes in moment of inertia relative to the baseline moment of inertia, when the density of the ball inside of the centroid radius varies relative to the density outside of the centroid radius. The moment of inertia of the ball inside of the centroid radius is that of a sphere, as shown above. The moment of inertia of the ball outside of the centroid radius is that of a thick shell and is determined by (2/5)(Mass of ball outside $R_{centroid}$) $(Ro^5-R_{centroid}{}^5)/(Ro^3-R_{centroid}{}^3)$ according to the CRC reference.

TABLE 6

| % Density inside $R_{centroid}$ | Inertia (new) | Changes in Inertia |
|---|---|---|
| 10% | 0.5998 | 0.1426 |
| 20% | 0.5839 | 0.1267 |
| 30% | 0.5681 | 0.1109 |
| 40% | 0.5522 | 0.0950 |
| 50% | 0.5364 | 0.0792 |
| 60% | 0.5205 | 0.0633 |
| 70% | 0.5047 | 0.0475 |
| 80% | 0.4888 | 0.0316 |
| 90% | 0.4730 | 0.0158 |
| 100% | 0.4571 | 0.0000 |
| 110% | 0.4413 | −0.0159 |
| 120% | 0.4254 | −0.0318 |
| 130% | 0.4095 | −0.0477 |
| 140% | 0.3937 | −0.0635 |
| 150% | 0.3778 | −0.0794 |
| 160% | 0.3620 | −0.0952 |
| 170% | 0.3461 | −0.1111 |
| 180% | 0.3303 | −0.1269 |
| 190% | 0.3144 | −0.1428 |

As shown, when the weight is allocated to the outside of the centroid radius, i.e., the density of the ball inside the centroid radius is less than 1.0, the moment of inertia is increased relative to the baseline moment of inertia. When the weight is allocated to the inside of the centroid radius, i.e., the density of the ball inside the centroid radius is greater than 1.0, the moment of inertia is decreased.

Ball 10, as shown in FIG. 1, comprises an inner core 12, at least two intermediate layers 14, 16 and a solid cover 18. Ball 20, as shown in FIG. 2, has an inner core 22 at least one intermediate layer 24 and a solid cover 26. Ball 30, as shown in FIG. 3, has an inner core 32, a relatively thin layer 34 and a cover 36. Cover 36 also has a plurality of dimples 38 defined thereon. Covers 18 and 26 may also have dimples.

In accordance to one aspect of the invention, ball 20 is a low moment of inertia ball comprising a high specific gravity inner core 22, encompassed by a low specific gravity layer 24. At least a portion of layer 24 is made with a density reducing filler or is otherwise reduced in density, e.g., with foam, to achieve a USGA legal weight ball. As used herein, the term low specific gravity layer means a layer or a portion of the layer that has its specific gravity reduced by a density reducing filler or other methods. Low specific gravity layer 24 may include a wound layer, but is preferably a non-wound layer. Inner core 22 and layer 24 are further encased within a solid cover 26. Preferably, the cover does not have a density adjusting element, except for pigments, colorants, stabilizers and other additives employed for reasons other than adjusting the density of the cover. Preferably, the high density or high specific gravity inner core 22 is positioned radially inward from the centroid radius. Ball 20, therefore, advantageously has a low moment of rotational inertia and high initial spin rates.

The core 22 preferably has the highest specific gravity of all the layers in ball 20. Preferably, the specific gravity of core 22 is greater than 1.8. The term specific gravity, as used herein, has its ordinary and customary meaning, i.e., the ratio of the density of a substance to the density of water at 4° C., and the density of water at this temperature is 1 g/cc. More preferably, the specific gravity of core 22 is greater than 2.0 and most preferably, the gravity of core 22 is greater than 2.5. The specific gravity of the core can be as high as 5.0, 10.0 or more. Core 22 may be made from a high density metal or from metal powder encased in a polymeric binder. High density metals such as steel, tungsten, lead, brass, bronze, copper, nickel, molybdenum, or alloys may be used. Core 22 may comprise multiple discrete layers of various metals or alloys. Core 22 may be a solid metal sphere or a hollow thick-walled metal sphere having an outer diameter in the range of 1.5 mm to 20 mm, more preferably in the range of 3 mm to 15 mm. It is noted that while most of the measurements in the application are given in English units, some materials are more readily available in SI units.

Alternatively, the core can be spherical, cubical, pyramid-shaped, geodesic or any three-dimensional, symmetrical shape. Carbon, stainless or chrome steel spheres are commercially available as ball bearings in sizes from 1 mm to 20 mm. Preferred sizes in English units are ¼ inches, ⅜ inches, 5/16 inches, 7/16 inches, ½ inches, ¾ inches or 11/16 inches in diameter. Ball bearings made out of mild steel have a specific weight of about 7.85 g/mL. Hence, a 7/16-inch-diameter ball bearing made out of mild steel weighs about 5.64 g. When the weight of the high specific gravity core 22 and the specific gravity of the solid cover 26 are known, the specific gravity of the low specific gravity layer 24 can be ascertained to reach a USGA legal weight ball. Also, if a hollow metal sphere is used, preferably the inner radius of the sphere is greater than 0.20 inches (about 5.1 mm) and more preferably greater than 0.25 inches (about 6.35 mm).

As stated above, at least a portion of layer 24 comprises a polymer containing a density reducing filler, or otherwise has its specific gravity reduced, e.g., by foaming the polymer. The effective specific gravity for this low specific gravity layer is preferably less than 0.9 and more preferably less than 0.8. The actual specific gravity is determined and balanced based upon the specific gravity and physical dimensions of the inner core 22 and the outer core 26.

The ball in accordance to the present invention may have more than one low specific gravity layer. For instance, ball 10, as shown in FIG. 1, may optionally have first and second low specific gravity layers 14 and 16, preferably with specific gravity less than 0.9 and more preferably less than 0.8. When ball 10 has more than one low specific gravity layer, one of the layers may be a wound layer. Thus, since ball 10 has low specific gravity layers 14 and 16, then layer 16 may be a wound layer. Alternatively, layer 14 can be a low specific gravity layer while layer 16 is a non-reduced specific gravity layer. On the other hand, layer 14 may be the non-reduced specific gravity layer, while layer 16 is the low specific gravity layer. Furthermore, one of the layers 14 or 16 can be made from a reaction injection molded ("RIM") polymer or cast polymer. Similarly, low specific gravity layer 24 and/or cover 18, 26 can be made from a RIM or cast polymer.

The low specific gravity layer can be made from a number of suitable materials, so long as the low specific gravity layer is durable, and does not impart undesirable characteristics to the golf ball. Preferably, the low specific gravity layer contributes to the soft compression and resilience of the golf ball. The low specific gravity layer can be made from a thermosetting syntactic foam with hollow sphere fillers or microspheres in a polymeric matrix of epoxy, urethane, polyester or any suitable thermosetting binder, where the cured composition has a specific gravity of less than 0.9 and preferably less than 0.8. Suitable materials may also include polyurethane foam or an integrally skinned polyurethane foam that forms a solid skin of polyurethane over a foamed substrate of the same composition. Alternatively, suitable materials may also include a nucleated reaction injection molded polyurethane or polyurea, where a gas, typically nitrogen, is essentially whipped into at least one component of the polyurethane, typically, the pre-polymer, prior to component injection into a closed mold where full reaction takes place resulting in a cured polymer having a reduced specific gravity. Furthermore, a cast or RIM polyurethane or polyurea may have its specific gravity further reduced by the addition of fillers or hollow spheres, for example. Additionally, any number of foamed or otherwise specific gravity reduced thermoplastic polymer compositions may also be used such as metallocene-catalyzed polymers and blends thereof described in U.S. Pat. Nos. 5,824,746 and 6,025,442. Moreover, any materials described as layer or cover layer materials in U.S. Pat. Nos. 5,919,100, 6152,834, and 6,149,535 and in PCT International Publication Nos. WO 00/23519 and WO 00/57962 with its specific gravity reduced are suitable materials. Disclosures from these references are hereby incorporated by reference. The low specific gravity layer can also be manufactured by a casting method, sprayed, dipped, injected or compression molded.

The non-reduced specific gravity layer may include a wound layer or a non-wound layer that is not reduced in specific gravity, i.e., its specific gravity is unmodified. The specific gravity of this layer may also be less than 0.9 and preferably less than 0.8, when materials such as metallocenes, ionomers, or other polyolefinic materials are used. Other suitable materials include polyurethanes, polyurethane ionomers, interpenetrating polymer networks, Hytrel® (polyester-ether elastomer) or Pebax® (polyamide-ester elastomer), etc., which may have specific gravity of less than 1.0. Additionally, suitable unmodified materials are also disclosed in U.S. Pat. Nos. 6,149,535, 6,152,834, 5,919,100, 5,885,172, WO 00/23519, and WO 00/57962. These references have already been incorporated by reference. The non-reduced specific gravity layer can be manufactured by a casting method, reaction injection molded, injected or compression molded, sprayed or dipped method.

The cover layer is a resilient, non-reduced specific gravity layer. Suitable materials include any material that allows for tailoring of ball compression, coefficient of restitution, spin rate, etc. and are disclosed in U.S. Pat. Nos. 6,419,535, 6,152,834, 5,919,100, 5,885,172, and WO 00/23519. Ionomers, ionomer blends, thermosetting or thermoplastic polyurethanes, metallocenes are the preferred materials. The cover can be manufactured by a casting method, reaction injection molded, injected or compression molded, sprayed or dipped method.

In another aspect of the invention, ball 30 is a high moment of inertia, low initial spin rate ball comprising core 32 and thin dense layer 34 and cover 36. Preferably, thin dense layer 34 is located proximate to outer cover 36, and preferably layer 34 is made as thin as possible. Layer 34 may have a thickness from about 0.001 inches to about 0.05 inches (0.025 mm to 1.27 mm), more preferably from about 0.005 inches to 0.030 inches (0.127 mm to 0.76 mm), and most preferably from about 0.010 inches to 0.020 inches (0.25 mm to 0.5 mm). Thin dense layer 34 preferably has a specific gravity of greater than 1.2, more preferably more than 1.5, even more preferably more than 1.8 and most preferably more than 2.0. Preferably, thin dense layer 34 is located as close as possible to the outer surface of ball 30, i.e, the land surface or the un-dimpled surface of cover 36. For golf ball having a cover thickness of 0.030 inches (0.76 mm), the thin dense layer would be located from 0.031 to 0.070 inches (0.79 mm to 1.78 mm) from the land surface including the thickness of the thin dense layer, well outside the centroid radius discussed above. For a golf ball having a cover thickness (one or more layers of the same or different material) of 0.110 inches (2.8 mm), the thin dense layer would be located from about 0.111 to 0.151 inches (2.82 mm to 3.84 mm) from the land surface, also outside the centroid radius. The advantages of locating the thin dense layer as radially outward as possible have been discussed in detail above. It is, however, necessary to locate the thin dense layer outside of the centroid radius.

Except for the moment of inertia, the presence of the thin dense layer preferably does not appreciably affect the overall ball properties, such as the feel, compression, coefficient of restitution, and cover hardness. However, the weight of the ball from inside the centroid radius, including the inner core 34, should be reduced accordingly to keep the ball to the USGA weight.

Suitable materials for the thin dense layer include any material that meets the specific gravity and thickness conditions stated above. The thin dense layer is preferably applied to the inner core 32 as a liquid solution, dispersion, lacquer, paste, gel, melt, etc., such as a loaded or filled natural or non-natural rubber latex, polyurethane, polyurea, epoxy, polyester, any reactive or non-reactive coating or casting material, and then cured, dried or evaporated down to the equilibrium solids level. The thin dense layer may also be formed by compression or injection molding, RIM, casting, spraying, dipping, powder coating, or any means of depositing materials onto the inner core. The thin dense layer may also be a thermoplastic polymer loaded with a specific gravity increasing filler, fiber, flake or particulate, such that it can be applied as a thin coating and meets the preferred specific gravity levels discussed above. One particular example of a thin dense layer, which was made from a soft polybutadiene with tungsten powder using the compression molded method, has a thickness of 0.021–0.025 inches (0.53 mm–0.64 mm) and a specific gravity of 1.31 and a Shore C hardness of about 72.

For reactive liquid systems, the suitable materials include any material which reacts to form a solid such as epoxies, styrenated polyesters, polyurethanes or polyureas, liquid PBR's, silicones, silicate gels, agar gels, etc. Casting, RIM, dipping and spraying are the preferred methods of applying a reactive thin dense layer. Non-reactive materials include any combination of a polymer either in melt or flowable form, powder, dissolved or dispersed in a volatile solvent. Suitable thermoplastics are disclosed in U.S. Pat. Nos. 6,149,535 and 6,152,834.

Alternatively, a loaded thin film or "pre-preg" or a "densified loaded film," as described in U.S. Pat. No. 6,010,411 ("the '411 patent) related to golf clubs, may be used as the thin film layer in a compression molded or otherwise in a laminated form applied inside the cover layer 36. The "pre-preg" disclosed in the '411 patent may be used with or without the fiber reinforcement, so long as the preferred specific gravity and preferred thickness levels are satisfied. The loaded film comprises a staged resin film that has a densifier or weighing agent, preferably copper, iron or tungsten powder evenly distributed therein. The resin may be partially cured such that the loaded film forms a malleable sheet that may be cut to desired size and then applied to the outside of the core or inside of the cover. Such films are available from the Cytec of Anaheim, Calif. or Bryte of San Jose, Calif.

The inner core 32 of ball 30 may be constructed from many materials including the core materials disclosed above, so long as its specific gravity counter-balances the high specific gravity of the thin dense layer, such that ball 30 is within the USGA legal weight. Inner core 32 is preferably a solid unitary or solid multi-piece core, and may include a wound layer, a liquid, a gel, and a hollow or foamed layer. The core may also include one or more layers of polybutadiene encased in a layer or layers of polyurethane. If a liquid form of the thin dense layer 34 is deposited next to a wound layer, the liquid material may penetrate into the wound layer. U.S Pat. No. 5,947,843 predicted that a prevulcanized latex material could penetrate to a depth of 0.050 inches. However, the depth of penetration depends on factors such as the viscosity and temperature of the liquid and the spacing or other surface phenomenon of the wound layer. When the inner core 32 is a solid or non-wound core, the thin dense layer in liquid form may leave a film having a thickness of 0.001 inches or higher. The liquid material may be cured with ultraviolet waves or dried with heat or at ambient conditions. When the liquid is dried with heat, the inner core material is preferably made from a thermosetting material to avoid heat softening of the core. A preferred latex is a pre-vulcanized Heveatex model No. 1704, manufactured by Heveatex Corporation of Fall River, Mass. Also, other latex coated cores are disclosed in U.S. Pat. Nos. 5,989,136 and 6,030,296. U.S. Pat. Nos. 5,993,968 discloses a wound core impregnated with a urethane dispersion (non-filled) prior to a thermoplastic material being injection molded over the core.

The cover for ball 30 can be made from the same materials as the cover for balls 10 and 20 discussed above. Preferably the core has a diameter from about 39 mm to 42 mm (about 1.54 inches to 1.64 inches) and more preferably from about 40 mm to 42 mm (1.56 inches to 1.64 inches). The core has a PGA compression of preferably less than about 90, more preferably less than about 80 and most preferably less than about 70.

Compression is measured by applying a spring-loaded force to the golf ball center, golf ball core or the golf ball to be examined, with a manual instrument (an "Atti gauge") manufactured by the Atti Engineering company of Union City, N.J. This machine, equipped with a Federal Dial Gauge, Model D81-C, employs a calibrated spring under a known load. The sphere to be tested is forced a distance of 0.2 inches (5 mm) against this spring. If the spring, in turn, compresses 0.2 inches, the compression is rated at 100; if the spring compresses 0.1 inches, the compression value is rated as 0. Thus more compressible, softer materials will have lower Atti gauge values than harder, less compressible materials. Compression measured with this instrument is also referred to as PGA compression. The approximate relationship that exists between Atti or PGA compression and Riehle compression can be expressed as:

(Atti or PGA compression)=(160-Riehle Compression).

Thus, a Riehle compression of 100 would be equated with an Atti or PGA compression of 60.

Figure 5:
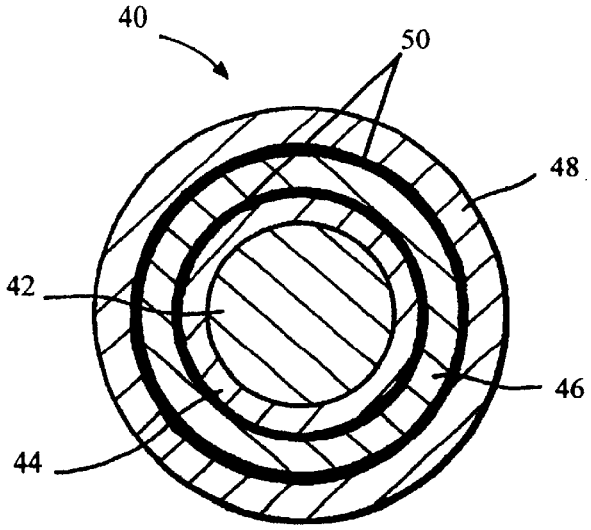
FIG. 5 is a cross-sectional view of a golf ball 40 having at least innermost core 42, one or more intermediate layers 44, 46, a cover 48 and a thin layer 50.

In accordance to another aspect of the invention, the thin dense layer as described in conjunction with ball 30 can be incorporated in a multi-layer ball having a specific gravity reduced innermost core. As shown in FIG. 5, ball 40 has innermost core 42, which is made from a material having its specific gravity reduced, as discussed above. Preferably, innermost core 42 is made from a foamed material or a material having low specific gravity filler, such as hollow microspheres, incorporated therein. Preferably the specific gravity of the innermost core 42 is less than 0.9 and more preferably less than 0.8. The actual specific gravity of the innermost core 42 depends on the weight distribution of the rest of the ball.

Ball 40 may have another specific gravity reduced layer 44 encasing innermost core 42. Materials suitable for innermost core 42 are also suitable for layer 44. Preferably, the specific gravity of layer 44 is less than 0.9, and more specifically less than 0.8. The specific gravity of layer 44 may differ from that of the innermost core 42. Layer 44 is encased by outer core 46 and cover 48.

Outer core 46 preferably has a thin dense layer incorporated therein. Alternatively, a separate thin dense layer 50 is located between layers 42 and 44, or between layer 44 and cover 48, as illustrated in FIG. 5. Most preferably, ball 40 has only one thin dense layer. However, it is possible and in some instances desirable to have more than one thin dense layer. As known in the art, and discussed in U.S. Pat. No. 5,823,889, cores with air pockets in the foamed material mimic the desirable soft feel effects of wound cores due to the compressibility of the pockets of air trapped in the wound core. In combination with thin dense layer 50, ball 40 may have the desired soft feel effect as well as the desired spin rate. Specifically, if the thin film layer is located between the center of the ball and the centroid radius, ball 40 has a high spin rate. Conversely, if thin dense layer 50 is located radially outward of the centroid radius, then ball 40 has a low spin rate in addition to a soft feel. Hence, in accordance to the present invention, a golf ball with unique characteristics is realized. Furthermore, a golf ball in accordance to the present invention can be designed for a specific golfer by taking into account that player's unique playing styles. For example, depending on the player's tendency to spin the ball, a thin dense layer can be positioned at the optimum radial location (see FIG. 4) to compensate for the spin, while not unnecessarily sacrifice the distance the ball with travel. Additionally, with the moment of inertia controlled by the thin dense layer, the remaining volume of the ball can be dedicated to improve other characteristics of the ball, such as soft feel by incorporating air pockets in the layers or core.

Alternatively, the inner core 42, intermediate layer 44 and outer core 46 can be made with a specific gravity reduced material. Inner core 42 may serve as a substrate or a preform for the application of additional layers thereon. Alternatively, layer 44 is not a specific gravity reduced layer, or outer core 46 itself may be a specific-gravity-reducing layer. When a thin dense layer is used, a wound outermost core layer can be positioned to encase the thin dense layer. For example, when thin dense layer 50 encases core 42, 44, outer core 46 can be the wound layer. In accordance to another aspect of the invention, the specific gravity of layers 42, 44 and 46 may constitute a specific gravity gradient with increasing values toward the outside, i.e., specific gravity of core 42 is less than the specific gravity of layer 44 which is less than specific gravity of layer 46. The specific gravity gradient may also go in the reverse direction, i.e., specific gravity of core 42 is greater than the specific gravity of layer 44 which is greater than the specific gravity of layer 46.

Suitable materials for the specific gravity reduced layer, the non-specific gravity reduced layer, the outer core, the thin dense layer and the cover discussed above are equally suitable for use with ball 40.

While various descriptions of the present invention are described above, it is understood that the various features of the present invention can be used singly or in combination thereof. Therefore, this invention is not to be limited to the specifically preferred embodiments depicted therein.

What is claimed is:

1. A golf ball comprising:

a solid inner core having a specific gravity of less than 0.9, a high-specific-gravity layer disposed around the core, said layer having a thickness between about 0.001 and about 0.05 inches and a specific gravity of greater than 1.8, and a cover of at least one layer disposed around the high-specific-gravity layer, wherein said inner core comprises a specific-gravity-reducing agent.

2. The golf ball of claim 1, wherein the specific-gravity-reducing agent is a foamed particulate; a filler; microspheres; a nucleated reaction injection molded polymer; a densified loaded film; polyurethanes; epoxies; polyesters; silicones and rubber latex; a thermoplastic polymer loaded with a specific gravity increasing agent; polybutadiene with tungsten powder, and mixtures thereof.

3. The golf ball of claim 1, wherein the high-specific-gravity layer is formed by compression or injection molding, reaction injection molding, casting, spraying, dipping or powder coating.

4. The golf ball of claim 1, wherein the inner core has a specific gravity of less than 0.8.

5. The golf ball of claim 1, further comprising an intermediate layer disposed between the inner core and the cover, wherein the intermediate layer has a specific gravity of less than 0.9 and is made from a material containing a specific-gravity-reducing agent.

6. The golf ball of claim 5, further comprising an inner cover disposed between the intermediate layer and the cover.

7. The golf ball of claim 6, wherein the inner cover is a wound layer.

8. The golf ball of claim 6, wherein the specific gravity of the inner core is less than the specific gravity of the intermediate layer and the specific gravity of the intermediate layer is less than the specific gravity of the inner cover.

9. The golf ball of claim 6, wherein the specific gravity of the inner core is more than the specific gravity of the intermediate layer and the specific gravity of the intermediate layer is more than the specific gravity of the inner cover.

10. The golf ball of claim 1, wherein the high-specific-gravity layer is disposed at a radial distance between the center of the ball and the centroid radius.

11. The golf ball of claim 1, wherein the high-specific-gravity layer is disposed at a radial distance outside of the centroid radius.

12. The golf ball of claim 1, wherein the high-specific-gravity layer has a thickness from about 0.001 inch to about 0.03 inch.

13. The golf ball of claim 1, wherein the ball has a weight between about 1.48 oz and about 1.58 oz.

14. The golf ball of claim 1, wherein the ball has a weight between about 1.60 oz and about 1.62 oz.

* * * * *